United States Patent [19]

Myrdal

[11] 3,967,513

[45] July 6, 1976

[54] TORQUE SIGNALING ATTACHMENT FOR TORQUE WRENCH

[76] Inventor: Jack L. Myrdal, 1260 Roy Road, Bellingham, Wash. 98225

[22] Filed: Aug. 29, 1975

[21] Appl. No.: 608,848

[52] U.S. Cl. ..... 81/52.5

[51] Int. Cl.[2] ..... B25D 23/142

[58] Field of Search ..... 81/52.4 R, 52.5; 340/267 R; 73/139, 1 C; 200/56 A, 61.47, 61.42, 61.27

[56] References Cited

UNITED STATES PATENTS

| | | | |
|---|---|---|---|
| 2,250,941 | 7/1941 | Zimmerman | 81/52.5 |
| 2,385,591 | 9/1945 | Sturtevant | 81/52.4 R |
| 2,442,359 | 6/1948 | Hattan | 81/52.5 |
| 3,076,362 | 2/1963 | Able | 81/52.4 R |
| 3,142,177 | 7/1964 | Hanscom et al. | 81/52.5 X |

*Primary Examiner*—James L. Jones, Jr.
*Attorney, Agent, or Firm*—Seed, Berry, Vernon & Baynham

[57] ABSTRACT

A torque signaling attachment for a conventional torque wrench for producing a visual or audible signal when the wrench is applying a predetermined torque. In a conventional torque wrench, the angular offset between the torque beam and the indicating pointer is proportional to the applied torque. The signaling attachment detects a predetermined lateral offset between the beam and pointer. The indicating device is secured to the torque beam, and the torque corresponding to the predetermined lateral offset is determined by the location of the signaling attachment on the beam. When the beam becomes laterally offset from the pointer by the predetermined amount, the pointer contacts the signaling device to complete an electrical circuit and produce a torque indicating signal. The signaling device is calibrated by applying a predetermined torque with the wrench and adjusting the position of the device along the torque beam until the signal occurs.

7 Claims, 3 Drawing Figures

TORQUE SIGNALING ATTACHMENT FOR TORQUE WRENCH

BACKGROUND OF THE INVENTION

1. Field of the Invention

This invention relates to torque wrenches and, more particularly, to a signaling device for indicating that the wrench is applying a predetermined torque.

2. Description of the Prior Art

Torque wrenches are commonly used to apply a preselected amount of torque to a threaded fastener. These wrenches generally include a cylindrical torsion head which engages the threaded fastener at one end thereof. Extending radially from the torsion head is a resilient torque beam terminating in a handle. An indicating pointer is also attached to the torsion head at a point axially spaced from the torque beam. When the torque beam is in its relaxed position, the indicating pointer extends generally along the length of the torque beam. As a circumferential force is applied to the handle, the torque beam deflects, thereby applying a torque to the torsion head. However, the indicating pointer remains in substantially its original position. The deflection of the torque beam, and hence the magnitude of the applied torque, is measured on an indicating plate which is secured to the torque beam. As the torque beam deflects, the lateral offset between the pointer and beam which corresponds to the applied torque is read from a scale on the indicating plate.

In operation, a circumferential force is applied to the handle while the operator monitors the deflection of the torque beam by examining the position of the indicating pointer with respect to the numbers on the indicator plate. As the circumferential force increases, so does the beam deflection and applied torque until the lateral offset between the beam and indicating pointer reaches a predetermined value, as shown on the indicator plate.

Conventional torque wrenches are frequently used under conditions which make it difficult for the operator to read the scale on the indicator plate as he applies torque to the threaded fastener. For example, his vision may be obscured, there may be insufficient light, or his full attention may be focused on the threaded fastener. Under these circumstances, an excessive torque may be applied, possibly fracturing the threaded fastener.

For the aforementioned reasons, it is desirable to produce a torque wrench which generates an audio or visual signal when the wrench is applying a predetermined torque. Several devices have been devised which are somewhat adequate in performing this function. Examples of these devices are disclosed in U.S. Pat. No. 2,250,941, issued to Zimmerman; U.S. Pat. No. 3,076,362, issued to Able; and U.S. Pat. No. 3,142,177, issued to Hanscom, et al. A primary disadvantage of most of the prior art signaling devices is that the torque wrench must be specially designed to accommodate the signaling devices. This unduly increases the cost of these torque wrenches, particularly for those individuals already possessing a conventional torque wrench. Prior art torque signaling devices attachable to conventional torque wrenches do not adequately inform the user that the predetermined torque has been applied, and thus do not eliminate the risk of inadvertent fracture of the threaded fastener.

SUMMARY OF THE INVENTION

It is an object of the invention to provide a signaling device which may be used with a conventional torque wrench.

It is another object of the invention to provide a torque signaling device which is easily calibrated.

It is still another object of the invention to provide a signaling device which may be set to a predetermined torque with great accuracy.

It is a still further object of the invention to provide a signaling device which produces an explicit warning which is extremely difficult to overlook.

These and other objects of the invention are accomplished by a signaling device which is secured to the torque beam of a torque wrench at any point along its length. The signaling device provides an indication whenever the lateral offset between the torque beam and the indicating pointer reaches a predetermined amount. Since the lateral offset between the pointer and beam is approximately proportional to both the angular offset between the pointer and beam and the distance of the signaling device from the torsion head, the applied torque producing the predetermined lateral offset may be adjusted by adjusting the position of the signaling device along the length of the torque beam.

DETAILED DESCRIPTION OF THE INVENTION

Figure 1:
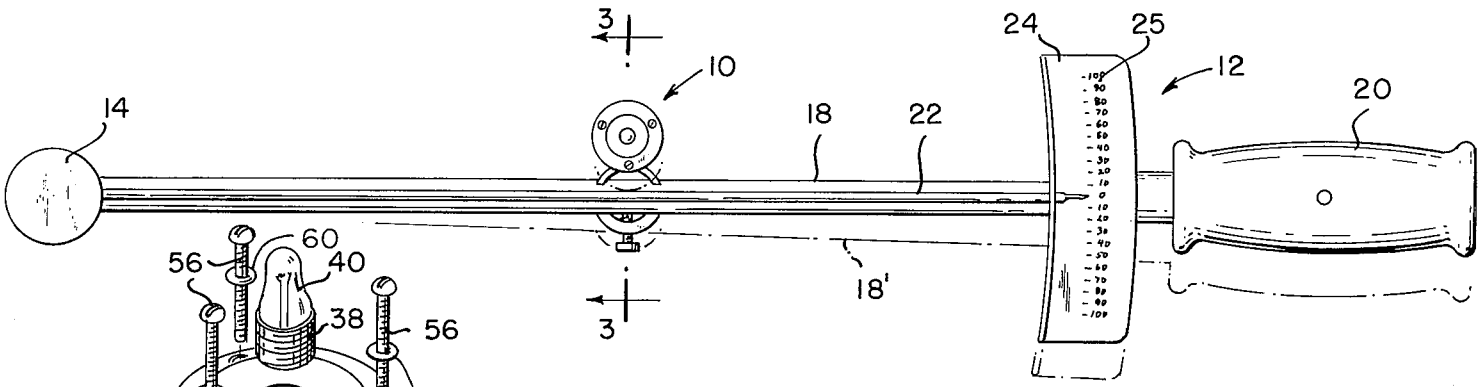
FIG. 1 is a top plan view of a conventional torque wrench with the signaling device installed thereon.

The signaling device 10 is shown installed on a conventional torque wrench 12 in FIG. 1. The conventional torque wrench includes a generally cylindrical torsion head 14 adapted to engage a threaded fastener, such as a bolt or nut. The torsion head 14 generally includes a square projection at one end adapted to engage a socket capable of receiving the head of a bolt or a nut. Extending radially from the torsion head 14 is a resilient torque beam 18. The end of the torque beam 18 terminates in a handle 20 of conventional design which is adapted to comfortably fit the hand of a user. A circumferential force exerted on the handle 20 applies a torque to the torsion head 14. The magnitude of the torque is equal to the product of the circumferential force and the length of the torque beam 18. The torque applied to the handle 20 deflects the torque beam 18 by an amount proportional to the magnitude of the applied torque. An indicating pointer 22 also projects radially from the torsion head 14 at a point axially spaced from the torque beam 18 such that the indicating pointer 22 extends along the length of the torque beam 18 when the beam is in a relaxed condition, as shown in FIG. 1. When the torque beam 18 is stressed responsive to circumferential forces on the handle 20, the beam 18 deflects, while the pointer 22 remains in substantially its original position. Under these circumstances, the torque beam 18' is laterally offset from the indicating pointer 22, as indicated in phantom in FIG. 1. An indicating plate 24 is secured to the torque beam 18, and the plate 24 contains a scale 25 indicating the degree of beam deflection corresponding to the torque applied to the torsion head 14.

In operation, the torsion head 14 engages a threaded fastener, and the operator applies a circumferential force to the handle 20, thereby deflecting the torque beam 18 until the indicating pointer 22 is adjacent the predetermined torque value on the scale 25 of the indicating plate 24. This procedure requires the operator to monitor the indicating plate 24 at all times.

The inventive torque signaling device 10 is clamped to the torque beam 18 at any desired point along its length, and it produces a visual indication when the indicating pointer 22 is offset from the torque beam 18 by a predetermined distance at the point of attachment to the torque beam 18.

Figure 2:
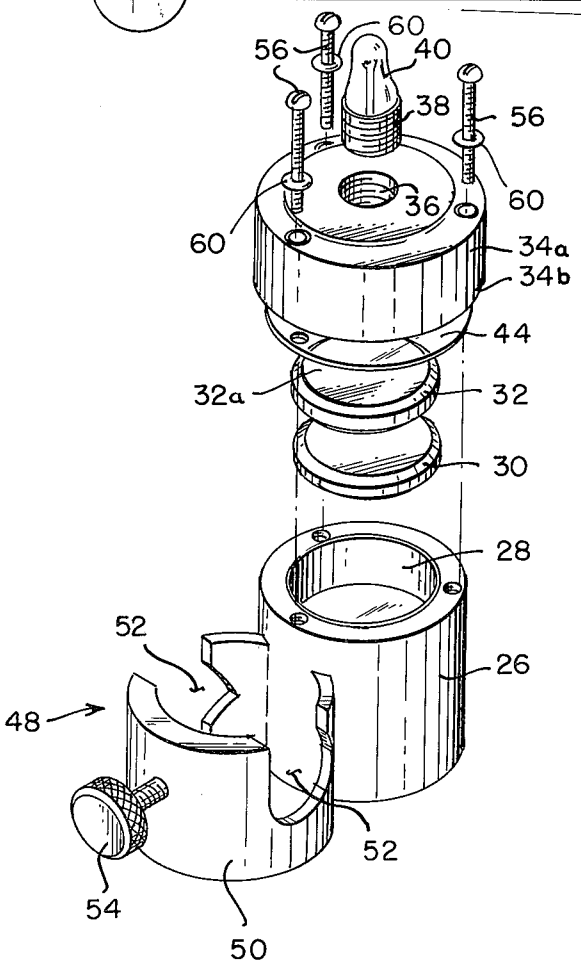
FIG. 2 is an exploded isometric view showing the construction details of the torque signaling device.
Figure 3:
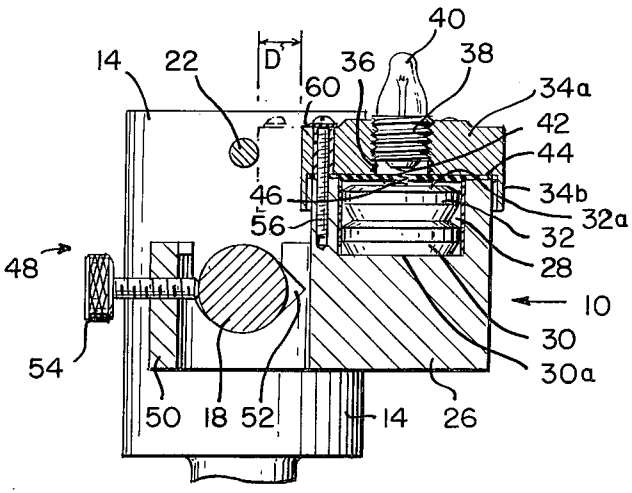
FIG. 3 is a cross-sectional view of the torque signaling device taken along the line 3—3 of FIG. 1. The indicating pointer is shown in phantom, with the torque wrench applying the preset torque.

The construction details of the signal device 10 are best illustrated in FIGS. 2 and 3. The indicating device 10 includes a generally cylindrical housing 26 having a cylindrical recess 28 lined with electrically insulating material and opening at one end. The diameter of the recess 28 is approximately equal to the diameter of a pair of batteries 30, 32. The batteries 30, 32 are well known in the art and are of the type having terminals of opposite polarity on opposite faces. The batteries 30, 32 are placed into the recess in series, with the face 30*a* of battery 30 abutting the end of the recess 28 and establishing electrical contact with the housing 26. The insulated material lining the wall of the recess prevents shorting of the batteries through the housing 26.

A generally cylindrical cover 34 is adapted to mate wih the housing 26 such that the sidewalls of the cover 34 project slightly beyond the sidewalls of the housing 26. The cover 34 includes a solid portion 34*a* and a hollowed out portion 34*b*. The inside diameter of the hollowed out portion 34*b* is slightly greater than the outside diameter of the housing 26 so that the cover 34 and housing are electrically isolated from each other. The cover 34 contains an axial bore 36 having internal threads adapted to receive the threads of a terminal 38 on the periphery of a bulb 40. The bulb 40, which is of conventional variety, also contains an axial terminal 42 at one end. An insulating sheet 44 covers the inside face of the cap solid portion 34*a* to insulate the cover 34 from the housing 26. The outer edge of the insulating sheet is recessed to receive the adjacent edge of the housing 26 so that the cover 34 is positioned at the center of the housing 26. The peripheral terminal 38 of the bulb 40 is in electrical communication with the cover 34, but it is electrically isolated from the housing 26. The insulating sheet 44 passes just below the axial terminal 42 of the bulb 40. A spring 46 passes through the insulating sheet 44 and extends between the terminal 42 and the top face 32*a* of battery 32. Thus the terminal 42 is electrically connected to the battery 32, and the electric circuit may be completed by electrically connecting the housing 26 to the cover 34.

The housing 26 is fastened to the torque beam 18 by a clamp 46 formed by a length of tube 50 containing aligned cutouts 52 adapted to receive the torque beam 18. A set screw 54 is threaded into a bore in the tube 50 and tightened against the torque beam 18 to prevent the clamp 48 from sliding along the torque beam 18. Since the clamp 46 is metal and thus electrically conductive, the clamp 48 electrically connects the torque beam 18 to the terminal 30*a* of the battery 30. Also, since both the torsion head 14 and indicating pointer 22 are electrically conductive, the indicating pointer 22 is also in electrical communication with the terminal 30*a*. Thus the indicating pointer 22 and the cover 34 form two terminals of electrical switch such that when the pointer 22 contacts the cover 34, the electric circuit is completed, thereby illuminating the bulb 40.

As illustrated in FIG. 3, when the torque beam 18 is in its relaxed condition, the indicating pointer 22 is separated from the housing 34 by a predetermined distance D. When the torque beam 18 is deflected responsive to an applied torque, the beam 18 becomes laterally offset from the pointer 22 until the cover 34 contacts the pointer 22 as shown in phantom, thereby illuminating the bulb 40.

The lateral offset between the pointer 22 and beam 18 is roughly proportional to both the angular offset between the beam 18 and pointer 22, as well as the distance from the torsion head 14 at which the signaling device is clamped to the beam 18. Since the angular offset is proportional to the applied torque, the signaling device may be preset to indicate any desired torque by adjusting the position of the signaling device 10 along the length of the torque beam 18.

The cover 34 is secured to the housing 26 by screws 56 which are threaded into the housing 26. Since the cover 34 must remain electrically isolated from the housing 26, each of the screws 56 is surrounded by an insulated sleeve 58 in the cover 34, and the heads of the screws 56 are separated from the cover 34 by insulated washers 60.

Although the signaling device has been illustrated as using a light bulb, it is understood that any signaling device, either audio or visual, may be used instead. Further, while the housing 26 and cover 34 are themselves conductive, these elements may be fabricated from non-conductive materials, and separate electrical conductors may be provided.

In operation, the torsion head 14 is clamped in a fixed position and a predetermined torque is applied to the torsion head 14 as indicated by the scale 25 on the indicating plate 24. The set screw 54 is loosened and the clamp 48 is slid along the length of the torque beam 18 until the indicating pointer 22 contacts the cover 34 to illuminate the bulb 40. The set screw 54 is then tightened against the torque beam 18 to fix the position of the signaling device 10 along the length of the beam 18. When the torque wrench is then used to tighten a threaded fastener, the signaling device indicates that the threaded fastener has been tightened to the preset torque.

The embodiments of the invention in which a particular property or privilege is claimed are defined as follows:

1. In a torque wrench having a metal torsion head adapted to engage a mechanical element, a resilient metal torque beam extending radially from said torsion head and terminating in a handle, a metal indicating pointer extending radially from said torsion head at a pointer axially spaced from said torque beam, and a torque indicating plate fastened to said torque beam intermediate said pointer, a torque indicating device comprising:

fastening means for attaching said device to said torque beam at a plurality of points along the length of said torque beam; and signal means for producing a signal when the lateral offset between said indicating pointer and said torque beam at said point of attachment is a predetermined value such that the value of applied torque actuating said signal means is adjusted by varying the location of said device along said torque beam.

2. The torque signaling device of claim 1 wherein said signal means comprise an electrical signaling device powered through an electrical switch, the contacts of said switch being formed by said indicating pointer and an electrical contact on said torque signaling device, said contact being laterally offset from said torque beam and intersecting a plane defined by the movement of said indicating pointer such that a lateral deflection of said torque beam of a predetermined distance causes said contact to abut said pointer to complete a circuit with said electrical signaling device.

3. The torque signaling device of claim 2 wherein said signal means comprise:

a cover portion having a central axis containing a threaded bore adapted to receive an electric lamp, one surface of said cover portion being said electrical contact;

a housing portion mating with said cover portion;

a battery contained within said housing;

an electric lamp inserted in said bore, said lamp having a first electric terminal around its periphery and a second electric terminal at one end thereof, said second terminal being in electrical communication with a terminal of said battery of one polarity;

a clamp fastening said housing portion to said torque beam;

first electrical conductor means for electrically connecting said torque beam to a terminal of said battery of opposite polarity; and second electrical conductor means for electrically connecting the electrical contact on said cover to said first electrical terminal.

4. A torque wrench signaling device comprising:

a cylindrical housing having an axial recess opening at one end and receiving a battery, said battery being coaxial with said housing such that a first terminal of said battery abuts the end surface of said recess, while a second, opposite terminal of said battery faces toward the opening of said recess;

a housing cover mating with said housing, said cover having an axial bore receiving an electric lamp, said lamp having a periphery terminal and an end terminal, said end terminal being in electrical communication with the second terminal of said battery;

fastening means for securing said cover to said housing;

a torque beam clamp connected to said housing, said clamp releasably securing said housing to said elongated beam;

a first contact terminal on said clamp adapted to abut said elongated beam, said terminal being in electrical communication with the first terminal of said battery; and a second contact terminal on said cover axially spaced from said clamp, said second contact terminal being in electrical communication with the periphery terminal of said lamp.

5. The signaling device of claim 4 wherein said housing, clamp and cover are fabricated from an electricity conducting metal, said device further including:

an insulating sheet isolating said cover from said housing said sheet passing between the end terminal of said lamp and the second terminal of said battery; and a metal projection extending through said sheet between said end terminal and second terminal, thereby placing said end terminal in electrical communication with the second terminal of said battery.

6. The signaling device of claim 5 wherein said fastening means comprise:

a plurality of bores extending axially through said cover and into said housing;

an insulating sleeve lining each cover bore; and a threaded fastener inserted into each bore and passing through said cover to engage threads in said housing, each of said fasteners passing through an insulated washer before entering said bore.

7. A method of calibrating a torque signaling device to correspond to a predetermined torque applied by a torque wrench, said torque wrench having a torsion head engaging a mechanical element, a torque beam extending radially from said torsion head and terminating in a handle, and an indicating pointer extending radially from said torsion head along the length of said beam at a point axially spaced therefrom, said torque signaling device being slidable along the length of said torque beam and producing an indicating signal when the lateral offset between said torque beam and indicating pointer is a predetermined value, said method comprising:

applying a predetermined torque with said wrench;

sliding said signaling device along said torque beam until said device produces an indicating signal; and securing said signaling device to said torque beam.

* * * * *